US005188508A

United States Patent [19]

Scott et al.

[11] Patent Number: 5,188,508

[45] Date of Patent: Feb. 23, 1993

[54] COMPACT FAN AND IMPELLER

[75] Inventors: Peter D. Scott, Port Ewen; Peter Bushnell, Skaneateles, both of N.Y.

[73] Assignee: Comair Rotron, Inc., Saugerties, N.Y.

[21] Appl. No.: 698,000

[22] Filed: May 9, 1991

[51] Int. Cl.[5] ..... F01D 1/02

[52] U.S. Cl. ..... 415/206; 415/207; 415/913; 416/180; 416/223 R

[58] Field of Search ..... 415/182.1, 203, 209, 415/206, 207, 913; 416/180, 197 C, 223 R, 223 B, 235, 237, 238, 242

[56] References Cited

U.S. PATENT DOCUMENTS

| | | | |
|---|---|---|---|
| 2,237,333 | 4/1941 | Bretzlaff et al. | 415/206 |
| 2,583,374 | 1/1952 | Hoffman | 415/913 |
| 3,139,259 | 7/1965 | Liebmann | 415/913 |
| 3,270,678 | 9/1966 | La Monica | 415/207 |
| 3,367,567 | 2/1968 | Burns | 415/207 |
| 3,575,524 | 4/1971 | Adajian | 415/913 |
| 4,371,313 | 2/1983 | Burgbacher et al. | 415/206 |
| 4,448,573 | 5/1984 | Franz | 415/182.1 |
| 4,467,217 | 8/1984 | Roussey | 416/223 R |
| 4,830,574 | 5/1989 | Wainauski et al. | 416/223 R |
| 4,919,592 | 4/1990 | Sears et al. | 415/207 |

FOREIGN PATENT DOCUMENTS

| | | | |
|---|---|---|---|
| 0334254 | 1/1936 | Italy | 416/223 R |
| 0001825 | 7/1863 | United Kingdom | 416/223 R |
| 0454072 | 9/1936 | United Kingdom | 415/207 |
| 2057567 | 4/1981 | United Kingdom | 415/207 |

*Primary Examiner*—John T. Kwon
*Assistant Examiner*—Christopher Verdier
*Attorney, Agent, or Firm*—Bromberg & Sunstein

[57] ABSTRACT

A compact centrifugal fan that draws air in past the impeller hub, which encloses a motor and which spins about a central axis, and then urges the air through a bend in the fluid passageway. As the air passes through the annular inlet channel about the impeller hub, it flows in a forward axial direction. The air passes through the bend in the fluid passageway, as the air is being swept around the hub by the blades of the impeller. After the air passes through the bend, it has a reverse axial flow component, in addition to a circumferential flow component. Air having a forward axial flow component passes by the portion of an impeller blade that is closest to the impeller hub, and air having a reverse axial flow component passes the portion of a blade that is furthest from the impeller hub.

28 Claims, 4 Drawing Sheets

COMPACT FAN AND IMPELLER

BACKGROUND OF THE INVENTION

Field of the Invention

The present invention relates generally to centrifugal fans and blowers, and in particular small centrifugal fans and blowers that may be used to cool electronic devices such as computers.

Description of the Related Art

A typical centrifugal fan includes an impeller rotatably mounted within a housing. The impeller is driven by a motor, the stator of which is fixedly mounted to the housing, and the rotor of which is fixedly mounted to the impeller. The centrifugal fan draws air in through an annular channel between the impeller and the housing. The blades of the impeller urge the air from a flow path that is generally parallel to the axis of the impeller, outward radially away from the hub of the impeller to a circular flow path. The axial dimension of this flow path remains constant, while the radial dimension of this flow path increases along the flow path. At the end of the circular flow path, where its radial dimension is at its greatest, the air exits the centrifugal fan through an outlet, which provides exit flow of the air in a direction transverse to the impeller's axis. Because the radial dimension of the circular flow path increases, centrifugal fans tend to be relatively wide. The blades of such centrifugal fans are shaped to provide a radial component to the air flowing from the channel to the circular flow path, so as to utilize the increase in the radial dimension of the flow path.

SUMMARY OF THE INVENTION

The invention is directed towards a centrifugal fan having a housing and an impeller, which is mounted on a motor. The impeller comprises a cylindrical hub and a plurality of blades disposed around the hub. The impeller is mounted within the housing, so that the impeller's hub and the housing form an annular channel, through which fluid may enter the fan in a direction that is generally parallel to the central axis of the impeller. A conduit is disposed within the housing, concentric with and outside of the channel. The conduit is coupled to the channel so that fluid may flow from the channel to the conduit. The conduit defines a circular flow path and is coupled to an outlet, which permits fluid to flow out of the fan in a direction transverse to the axis. The axial dimension of the conduit increases along the circular flow path, and its radial dimension is substantially constant along the circular flow path.

Each blade of the impeller has a root region disposed proximally to the hub and a tip region disposed distally from the hub. The root region is shaped to provide forward axial flow, i.e., flow into the fan. The tip region is shaped so as to reverse the direction of the flow, so as to urge the fluid into the conduit. Therefore, in addition to urging the fluid through the circular flow path, the tip region also provides the flow with a reverse axial component sufficient to utilize the increase in the axial dimension of the conduit along the flow path.

The outer edge of the tip region is shaped to conform to the radial dimension of a conduit. The tip of each blade may be axially displaced from the root, in the direction of forward axial flow. The tip may also extend axially beyond the hub in the direction of forward axial flow. The root of each blade may include a generally triangular portion configured so that the distance between the edge of such portion and the impeller's central axis increases approximately linearly in the direction of forward axial flow. The conduit may have an inner surface that, at the extreme limit of forward axial flow, has a curved cross section, and the edge of the tip region of the blade proximate to this curved cross section may be shaped to conform with such surface. The edge of the tip region that is distal from the curved cross section of the conduit may be a substantially straight line segment transverse to the central axis. The surfaces of the tip region and the root region may be disposed at approximately the same angle with respect to the hub's axis. The leading and trailing faces of the tip region may be curved in such a way that the leading face is slightly concave. The cross section of the tip region, taken through a plane approximately perpendicular to the blade's faces and parallel to the axis, smoothly decreases in thickness in the direction of forward axial flow, such that the edge of the blade proximal to the curved inner surface of the channel is relatively slim.

DESCRIPTION OF SPECIFIC EMBODIMENTS

Figure 1:
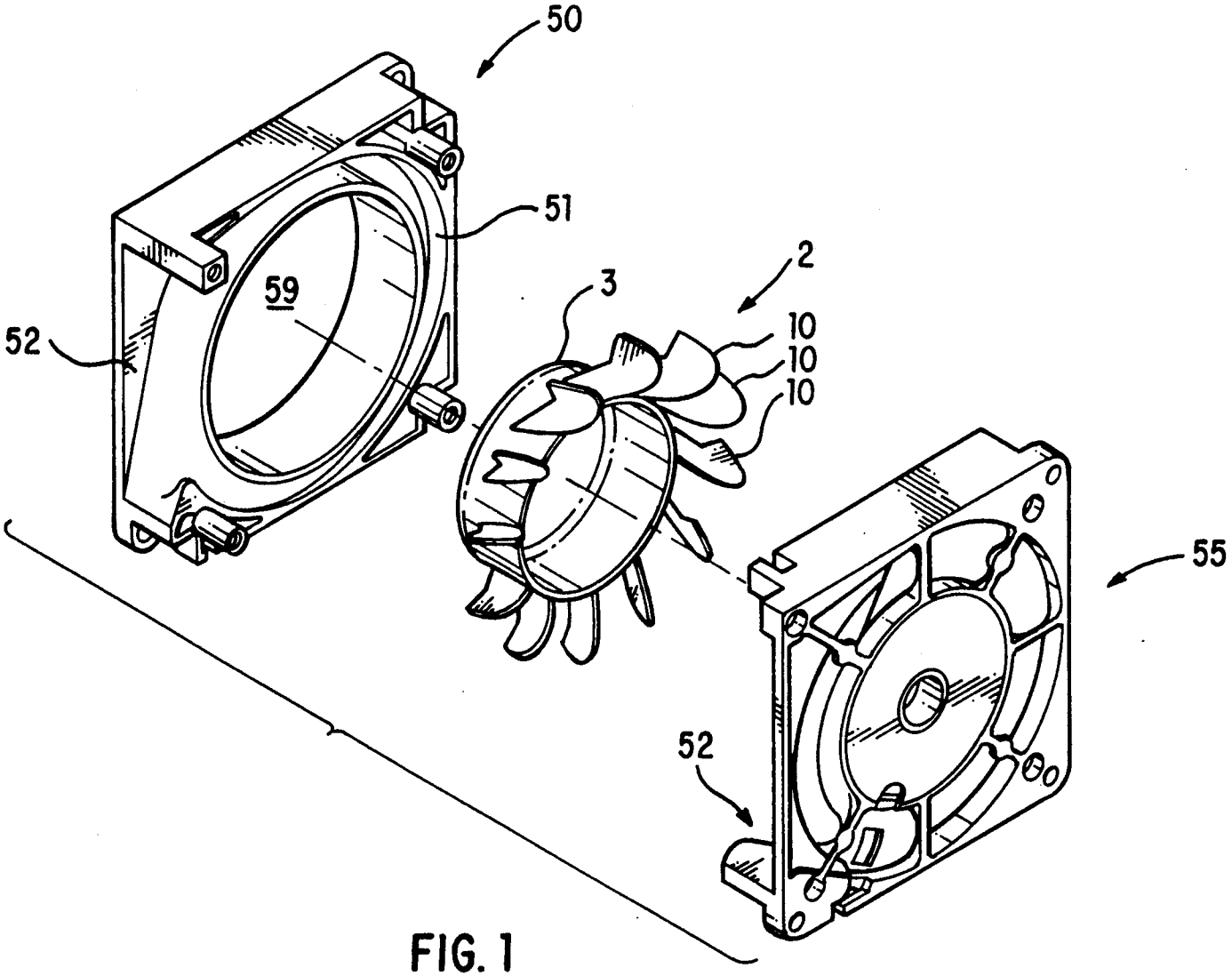
FIG. 1 shows an exploded, perspective view of a centrifugal fan according to the invention.

FIG. 1 shows several of the major components of a fan according to the present invention. An impeller 2 is mounted between the upper and lower halves of the housing, 50 and 55. The impeller 2 has a central cylindrical hub 3 and a plurality of blades 10 mounted on the hub 3. The impeller 2 is mounted concentrically within the large aperture 59 of the upper half 50 of the housing. A conduit 51 is disposed in the housing concentrically about the large aperture 59. This conduit 51 opens to a large outlet 52 mounted on the side of the housing.

Figure 2:
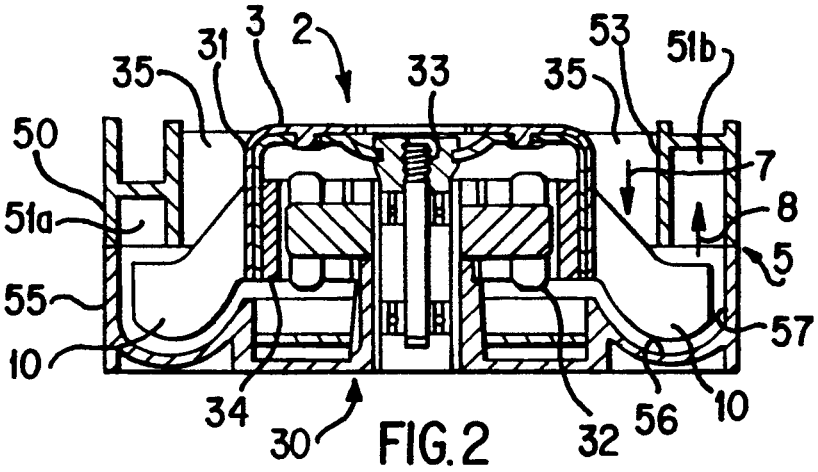
FIG. 2 shows a cross section of an assembled fan according to the invention.

FIG. 2 shows a cross section of the assembled fan, and the channel 35 formed between the circumferential wall 31 of the hub 3 and the inner wall 53 of the upper half 50 of the housing 5. FIG. 2 also shows cross sections of the conduit 51. The axial dimension of the conduit 51 increases along the circular flow path, so that cross section **51*b* has a greater axial dimension than cross section 51*a*. The radial dimension of the conduit, defined by the outer wall 57 of the lower half 55 of the housing, remains substantially constant along most of the circular flow path. Of course, at and near the outlet, where there is a transition between the conduit 51 and the outlet 52, the radial dimension essentially increases rapidly to infinity. The portion of the conduit 51 disposed in the lower half 55 of the housing 5 is swept by the blades 10. As the impeller 2 rotates, the air is forced along the circular flow path and conduit 51**.

The impeller 2 is driven by a motor 30, which may be an inverted DC brushless motor. The hub 3 may be fixedly mounted on the rotor 34, and the stator 32 may be fixedly mounted to the housing 5. The shaft 33 is fixedly attached to the impeller 2 and is rotatably mounted within the stator 32. The shaft 33 is aligned with the central axis of the impeller 2.

As the impeller 2 is rotated, air is drawn through the channel 35, in an axial direction. The air is forced from the channel 35 outward to the conduit 51. In a typical prior-art centrifugal fan the conduit expands in a radial direction. In the present invention the conduit 51 does not expand in a radial direction, but rather expands in an axial direction, as shown by the increase in the size of the conduit from cross section 51*a* to cross section 51*b*. Air is forced through the conduit 51 and exits the housing through outlet 52.

The bottom surface 56 of the region where the air is forced from the channel 35 towards the conduit 51 is curved as shown in FIG. 2. This curved, generally U-shaped surface 56 urges the air flow to change direction from forward axial, as shown by arrow 7, to reverse axial, as shown by arrow 8. Of course, as the air is being urged from a forward axial 7 to reverse axial 8 flow, it is also being moved in a circumferential direction by impeller blades 10.

Figure 4:
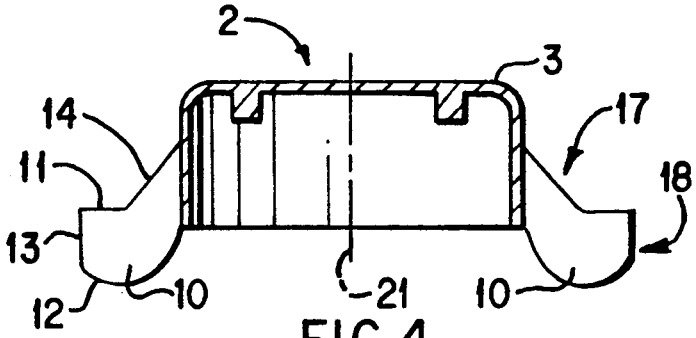
FIG. 4 shows a cross section of the impeller shown in FIG. 3.
Figure 3:
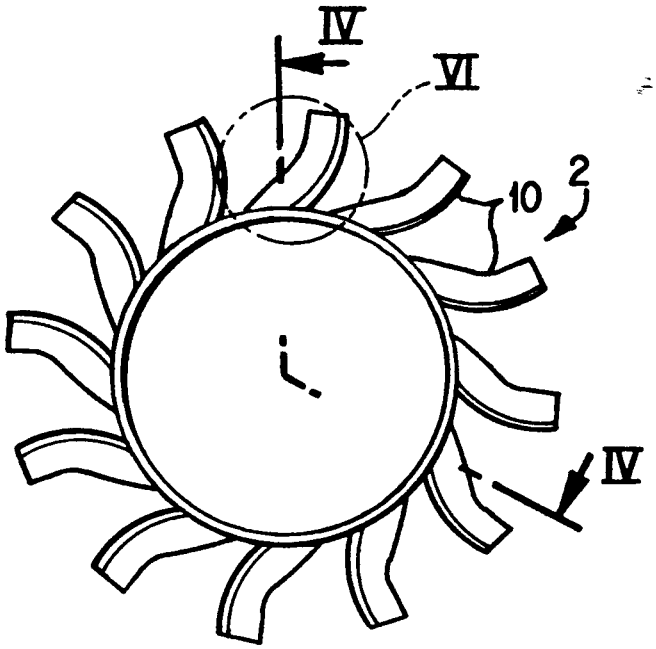
FIG. 3 shows a bottom plan view of the impeller.

FIG. 3 shows a bottom plan view of the impeller 2 shown in FIG. 2. FIG. 4 is a cross section of the impeller taken where indicated by the dash lines in FIG. 3.

FIG. 4 shows a cross section of the impeller 2 of FIG. 2. The bottom edge 12 of each impeller blade 10 is curved to conform with the shape of the curved bottom surface 56 of the conduit 51. The outer edge 13 of the impeller blade 10 conforms with the inner face 57 of the outer wall of the housing 5 shown in FIG. 2. The blade 10 may be considered to have two different regions, a root region 17 and a tip region 18. The tip region 18 is axially displaced, from the root region, in a direction of forward axial flow and extends axially below the hub. (Although the terms upper, lower, top, bottom, above and below are used in describing the features of the fan shown in FIGS. 2 and 4, this is not meant to limit how the fan may be oriented; indeed, the fan may be oriented in any direction.) The root portion of each blade includes a generally triangular portion. The hypotenuse 14 of this triangular portion slopes down and away from the hub 3, so that the bottom of this hypotenuse 14 is further away from the central axis 21 of impeller 2 than the top.

Figure 5:
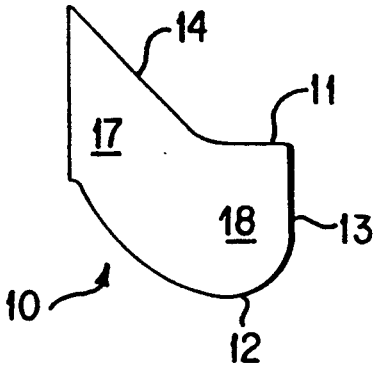
FIG. 5 shows a plan view of a face of the blade of the impeller.

FIG. 5 shows a front plan view of an impeller blade 10, with a curved bottom edge 12 and a substantially straight outer edge 13, which conform with the surfaces 56 and 57 of the housing 5. The top edge of the root region 17 of the blade 10 slopes down and away from the hub. The top edge 11 of the tip region 18 of the blade 10 is straight and generally perpendicular to the axis 21 of the impeller 2.

Figure 7:
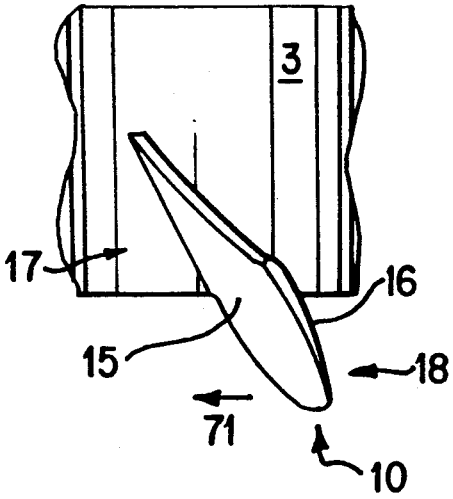
FIG. 7 shows a radial view of the portion of the impeller shown in FIG. 6.

FIG. 7 shows a side view of a portion of the impeller 2. The blade 10 has a leading, or pressure, face 15 and a trailing, or suction, face 16. When the impeller 2 rotates the blade moves in the direction of arrow 71. As can be seen in FIG. 7, the blade 10 is disposed at an angle, such that the tip region 18 trails the root region 17. The leading face 15 is concave and the trailing face 16 is convex.

Figure 6:
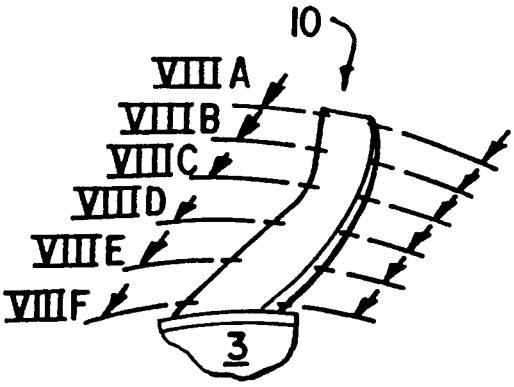
FIG. 6 shows a bottom view of a portion of the impeller shown in FIG. 3.
Figure 8:
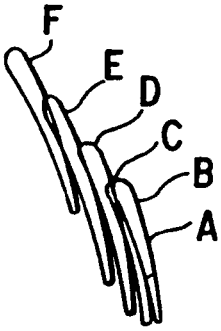
FIG. 8 shows six cross sections of the blade shown in FIG. 6.

FIG. 6 shows a top view of the portion of the impeller encircled in FIG. 3. FIG. 8 shows six cross sections of the blade shown in FIG. 6. FIGS. 7 and 8 show that the cross sections through the tip region smoothly decrease in thickness as one goes down the blade, i.e., in the direction of forward axial flow.

Figure 9:
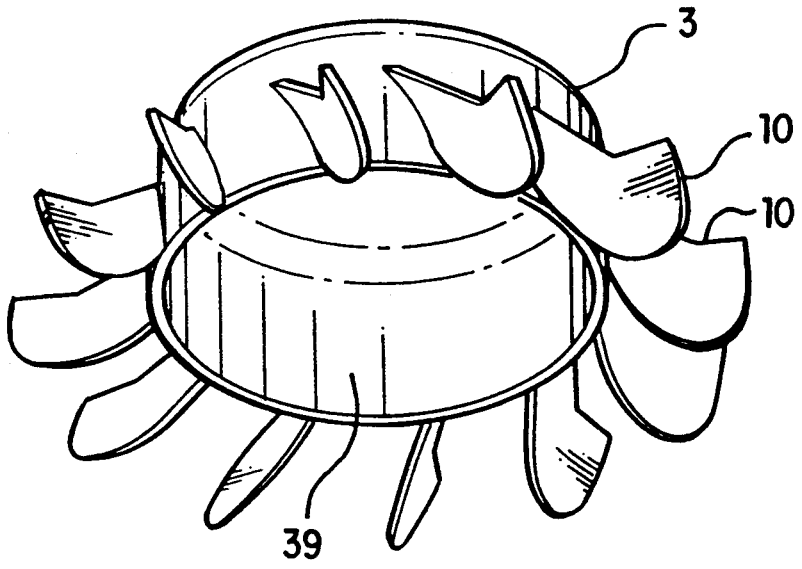
FIG. 9 shows a perspective view of the impeller.

FIG. 9 shows a perspective view of the impeller 2. The impeller 2 may be made by a straight-pull injection molding process.

The geometries of the conduit 51 and the impeller blades 10 allow the fan to have smaller overall dimensions, and to operate relatively quietly.

What is claimed is:

1. An impeller comprising:

a cylindrical hub having a central axis; and a plurality of blades disposed around the hub, each blade having a root region disposed proximally to the hub and a tip region disposed distally from the hub, each blade having a curved edge extending from the root region to the tip region, the root region having, distal from the curved edge, a generally straight edge that is configured so that the distance from the central axis to the root region's straight edge increases approximately linearly in the direction towards the curved edge, and the tip region having, distal from the curved edge, a substantially straight edge that is disposed at an angle with respect to the root region's straight edge so that the tip region's straight edge is substantially more perpendicular to the central axis than the root region'straight edge.

2. An impeller according to claim 1, wherein the tip region of each blade is axially displaced, from the root region, in the direction of the curved edge.

3. An impeller according to claim 2, wherein the tip region of each blade extends axially beyond the hub, in the direction of the curved edge.

4. An impeller according to claim 1, wherein the tip region is disposed in approximately the same plane as is the root region.

5. An impeller according to claim 1, wherein each blade is disposed at an angle with respect to a normal to the surface of the hub where the blade is disposed, such that the tip region trails the root region.

6. An impeller for use in a centrifugal fan, the flow through which initially has a forward axial flow component and becomes flow with a reverse axial flow component, comprising:

a cylindrical hub;

a plurality of blades disposed around the hub, each blade having a root region disposed proximally to the hub, where the flow has a forward axial flow component and a circumferential flow component, and a tip region disposed distally from the hub, where the flow has a reverse axial flow component and a circumferential flow component, wherein the surface of the tip region is disposed in approximately the same plane as in the root region, wherein the tip region has leading and trailing faces and the blade is curved in such a way that the leading face is slightly concave.

7. An impeller according to claim 6, wherein the tip region has a section, taken through a plane approximately perpendicular to the faces and parallel to the axis, that smoothly decreases in thickness in the direction of forward axial flow, so that the edge of the blade region where forward axial flow terminates and reverse axial flow begins is relatively slim.

8. An impeller according to claim 6, wherein each blade has a curved edge where the flow having a forward axial flow component terminates and flow having a reverse axial flow component begins, and the tip region, along the edge distal from the curved edge, is substantially a straight line segment transverse to the axis.

9. An impeller for use in a centrifugal fan, the flow through which initially has a forward axial flow component and becomes flow with a reverse axial flow component, comprising:

a cylindrical hub;

a plurality of blades disposed around the hub, each blade having a root region disposed proximally to the hub, where the flow has a forward axial flow component and a circumferential flow component, and a tip region disposed distally from the hub, where the flow has a reverse axial flow component and a circumferential flow component, each blade having a curved edge where forward axial flow terminates and flow having a reverse axial flow component begins, wherein the tip region, along the edge distal from the curved edge, is substantially a straight line segment transverse to the axis.

10. An impeller for use in a centrifugal fan, the flow through which initially has a forward axial flow component and becomes flow with a reverse axial flow component, comprising:

a cylindrical hub;

a plurality of blades disposed around the hub, each blade having a root region disposed proximally to the hub, where the flow has a forward axial flow component and a circumferential flow component, and a tip region disposed distally from the hub, where the flow has a reverse axial flow component and a circumferential flow component, each blade having a curved edge where forward axial flow terminates and flow having a reverse axial flow component begins, wherein the tip region has a section, taken through a plane approximately perpendicular to the blades and parallel to the axis, the smoothly decreases in thickness in the direction of forward axial flow, so that the curved edge of the blade is relatively slim, wherein the tip region, along the edge distal from the curved edge, is substantially a straight line segment transverse to the axis.

11. A centrifugal fan providing a fluid flow path, the fan comprising:

an open annular channel, having a central axis, for axial flow entry of fluid into the fan;

a conduit, disposed concentrically outside of the channel, providing a circumferential flow path, having an inlet coupled to the channel and an a outlet providing exit flow of fluid transverse to the central axis directly from the conduit, and having an axial dimension that increases along the circumferential flow path and an outer radial dimension that is substantially constant along the flow path;

a motor disposed concentrically inside the channel;

a cylindrical hub attached to the motor and rotatable about the central axis, the hub forming a boundary to the annular channel; and a plurality of blades disposed around the hub, each blade having a root region disposed proximally to the hub, where the flow has a forward axial flow component and a circumferential flow component, such that the root region passes through a portion of the channel, and a tip region disposed distally from the hub, where the flow has a reverse axial flow component and a circumferential flow component, such that the tip region passes through a portion of the conduit, the outer edge of the tip region shaped to conform to the outer radial dimension of the conduit.

12. A fan according to claim 11, wherein the tip region of each blade is also axially displaced from the root region, so that the tip region extends axially beyond the hub, in the direction of forward axial flow.

13. A fan according to claim 12, wherein the root region of each blade includes a generally triangular portion configured so that the distance from the central axis to the outer edge of such portion increases approximately linearly in the direction of forward axial flow.

14. A fan according to claim 13, wherein the conduit has an inner surface that, at the extreme limit of forward axial flow, has a curved cross section and wherein the edge of the tip region of the blade proximal thereto is shaped to conform with such surface.

15. A fan according to claim 14, wherein each blade is disposed at an angle with respect to a normal to the surface of the hub where the blade is disposed such that the tip region trials the root region, and wherein the tip region is disposed in approximately the same plane as is the root region.

16. A centrifugal fan providing a fluid flow path, the fan comprising:

an open annular channel, having a central axis, for axial flow entry of fluid into the fan;

a conduit, disposed concentrically outside of the channel, providing a circumferential flow path, having an inlet coupled to the channel and an a outlet providing exit flow of fluid transverse to the axis, and having an axial dimension that increases along the circumferential flow path and an outer radial dimension that is substantially constant along the flow path;

a motor disposed concentrically inside the channel;

a cylindrical impeller hub attached to the motor and rotatable about the central axis, such that the hub forms a boundary to the annular channel; and a plurality of blades disposed around the hub, each blade having a root region disposed proximally to the hub, where the flow has a forward axial flow component and a circumferential flow component, and a tip region disposed distally from the hub, where the flow has a reverse axial flow component and a circumferential flow component, such that the tip region passes through a portion of the conduit, the outer edge of the tip region shaped to conform to the outer radial dimension of the conduit, wherein the tip region of each blade is also axially displaced from the root region, so that the tip region extends axially beyond the hub, in the direction of forward axial flow, wherein the root region of each blade includes a generally triangular portion configured so that the distance from the central axis to the outer edge of such portion increases approximately linearly in the direction of forward axial flow, wherein the channel has a surface that has a curved cross section where forward axial flow ends and reverse axial flow begins and wherein the edge of the tip region of the blade proximal thereto is shaped to conform with such surface, wherein the each blade is disposed at an angle with respect to a normal to the surface of the hub where the blade is disposed such that the tip region trails the root region, and wherein the tip region is disposed in approximately the same plane as is the root region, and wherein the tip region has leading and trailing faces and the blade is curved in such a way that the leading face is slightly concave.

17. A fan according to claim 16, wherein the tip region has a section, taken through a plane approximately perpendicular to the faces and parallel to the axis, that smoothly decreases in thickness in the direction of forward axial flow, so that the edge of the blade region proximal to the curved inner surface of the conduit is relatively slim.

18. A fan comprising:

a housing;

an impeller having a plurality of blades mounted on a hub;

a motor having a stator fixedly mounted to the housing and a rotor fixedly attached inside the hub, such that the motor, when energized, causes the impeller to spin; and a fluid passageway, defined by the housing and the hub, such that fluid is drawn in a forward axial direction through an annular inlet between the hub and the housing and swept in a circumferential direction by the blades of the impeller, the fluid passageway having a bend such that the fluid is urged from a forward axial direction to a reverse axial direction, as the fluid is being swept in a circumferential direction by the blades.

19. A fan according to claim 18, wherein the fluid passageway after the bend, where fluid has a reverse axial flow components, is adjacent to and concentrically outside of the annular inlet.

20. A fan according to claim 19, wherein the fluid passageway has an outlet providing fluid exiting the fan to flow in a direction transverse to the central axis.

21. A fan according to claim 19, wherein each blade has a root region disposed proximally to the hub, where the flow has a forward axial flow component and a circumferential flow component, and a tip region disposed distally from the hub, where the flow has a reverse axial flow component and a circumferential flow component, the outer edge of the tip region shaped to conform to the outer radial dimension of the passageway.

22. A fan according to claim 21, wherein the root region of each blade includes a generally triangular portion configured so that the distance from the central axis to the outer edge of such portion increases approximately linearly in the direction of forward axial flow.

23. A fan according to claim 22, wherein the passageway has a wall with a curved cross section at the bend, and wherein the edge of the blade proximal thereto is shaped to conform with such curved cross section.

24. A fan according to claim 23, wherein each blade is disposed at an angle with respect to a normal to the surface of the hub where the blade is disposed such that the tip region trails the root region.

25. A fan according to claim 24, wherein the tip region of each blade is also axially displaced from the root region, so that the tip region extends axially beyond the hub, in the direction of forward axial flow.

26. An impeller for use in a centrifugal fan, the flow through which initially has a forward axial flow component and becomes flow with a reverse axial flow component, the impeller comprising:

a cylindrical hub having a central axis; and a plurality of blades disposed around the hub, each blade having a root region disposed proximally to the hub, where the flow has a forward axial flow component and a circumferential flow component, and a tip region disposed distally from the hub, where the flow has a reverse axial flow component and a circumferential flow component, each blade having a curved edge where flow with a forward axial flow component terminates and flow having a reverse axial flow component begins, and the root region including a generally triangular portion configured so that the distance from the central axis to the outer edge of the triangular portion increases approximately linearly in the direction of forward axial flow.

27. An impeller according to claim 26, wherein the tip region of each blade is axially displaced, from the root region, in the direction of forward axial flow.

28. An impeller according to claim 27, wherein the tip region of each blade extends axially beyond the hub, in the direction of forward axial flow.

* * * * *